US007650090B2

(12) United States Patent
Hatakeyama et al.

(10) Patent No.: US 7,650,090 B2
(45) Date of Patent: Jan. 19, 2010

(54) IMAGE FORMING APPARATUS HAVING FUSION CONTROL CIRCUIT THAT OPERATES EVEN IN THE PRESENCE OF A SHORT CIRCUIT

(75) Inventors: Motonobu Hatakeyama, Tokyo (JP); Kazuaki Arai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 288 days.

(21) Appl. No.: 11/768,225

(22) Filed: Jun. 26, 2007

(65) Prior Publication Data

US 2008/0124100 A1 May 29, 2008

(30) Foreign Application Priority Data

Jun. 26, 2006 (JP) ..... 2006-175350

(51) Int. Cl.
*G03G 15/20* (2006.01)

(52) U.S. Cl. ..... 399/33; 399/69

(58) Field of Classification Search ..... 399/33, 399/67, 69

See application file for complete search history.

(56) References Cited

U.S. PATENT DOCUMENTS 3,809,475 A * 5/1974 Post et al. ..... 399/33
4,745,430 A * 5/1988 Tsuchiya ..... 399/33
2005/0111864 A1* 5/2005 Yamaguchi ..... 399/69
2005/0117923 A1* 6/2005 Sasamoto et al. ..... 399/69 X
2005/0135820 A1* 6/2005 Morihara et al. ..... 399/33

FOREIGN PATENT DOCUMENTS

JP 08-006431 A 1/1996

* cited by examiner

*Primary Examiner*—Sandra L Brase
(74) *Attorney, Agent, or Firm*—Panitch Schwarze Belisario & Nadel LLP

(57) ABSTRACT

An image forming apparatus containing a fusing device, a commercial power source providing power to the fusing device, a triac, a thermistor detecting a temperature of the fusing device, a fusion control unit controlling the fusing device based on a detection result of the thermistor, and a cathode terminal outputting a control current and an anode terminal receiving the control current to control the power supplied to the heating body from the commercial power source and the triac. The fusion control unit of the image forming apparatus contains a control current output terminal outputting the control current to the anode terminal, a control current input terminal receiving the control current from the cathode terminal, and a fusion temperature control unit controlling the control current received by the control current input terminal and the control current output by the control current output terminal.

12 Claims, 4 Drawing Sheets

IMAGE FORMING APPARATUS HAVING FUSION CONTROL CIRCUIT THAT OPERATES EVEN IN THE PRESENCE OF A SHORT CIRCUIT

BACKGROUND OF THE INVENTION

1. Field of the Invention

The present invention relates to an image forming apparatus, and more particularly to an image forming apparatus equipped with a fusing device for heat fusing developer onto paper serving as a printing medium.

2. Description of Related Art

Patent Document 1 (Japanese Patent Application Publication hei8-6431) is provided as an example of a conventional image forming apparatus equipped with the type of fusing device mentioned above.

In the image forming apparatus disclosed in Patent Document 1, unusual heating is detected inside the fusing device using a thermistor, and the power supply to the heating body is forced off to prevent damage to the fusing device when the temperature of the heating body exceeds a predetermined temperature.

In the example of the conventional image forming apparatus mentioned above, however, because the heating body inside the fusing device is frequently connected to a commercial power source, a power control unit for supplying the power to the heating body is frequently disposed near a commercial power source unit. Accordingly, a control unit controlling the image forming apparatus and the power control unit are separated and connected by a wire material such as a connection cable. Therefore, in the apparatus having the structure described above, in a case where, for example, the connection cable short circuits to a frame ground or the like of the apparatus because of some abnormality, a control signal from the control unit flows in a direction of the ground, causing the power control unit to be unable to turn off. Therefore, the power control unit is not turned off, so that the power is continuously supplied to the heating body from the commercial power source, causing abnormal heating of the heating body while the power control unit remains turned on. The abnormal heating of the heating body causes the problem of abnormal heating of the fusing device, which damages the fusing device.

BRIEF SUMMARY OF THE INVENTION

It is an objective of the present invention, taking the above situation into consideration, to provide an image forming apparatus that can control an internal temperature of the fusing device even in a case where a short circuit arises for some reason between the power control unit and the control unit.

To achieve the aforementioned objective, the image forming apparatus according to the present invention contains a fusing device for heating a heating body with supplied power to fuse developer onto a printing medium, a power supply unit for supplying the power to the fusing device, a temperature detection unit for detecting a temperature of the fusing device, a fusion temperature control unit for controlling the power supplied to the fusing device from the power supply unit based on a detection result of the temperature detection unit, an input unit, electrically isolated from the power supply unit, for receiving a control current for controlling the power supplied to the heating body from the power supply unit, and an output unit, electrically isolated from the power supply unit, for outputting the control current received by the input unit. The fusion control unit of the image forming apparatus contains a control current output unit for outputting the control current to the input unit, a control current input unit for receiving the control current output from the control current output unit, a control current output control unit for controlling the control current output by the control current output unit based on the detection result of the temperature detection unit, and a control current input control unit for controlling the control current received by the control current input unit based on the detection result of the temperature detection unit.

Through the aforementioned structure, the power supplied to the fusing device from the power supply unit is input into the input unit from the control current output unit of the fusion control unit and is therefore controlled by the control current output to the control current control current input unit from the output unit. That is, in the image forming apparatus, the fusion control unit can control the power supplied to the fusing device from the power supply unit by both the control current input into the control current input unit from the output unit and the control current output to the input unit from the control current output unit.

In the aforementioned image forming apparatus of the present invention, the fusion control unit can control the fusing device even in a case where a short circuit arises for some reason between the power supply unit supplying power to the fusing device and the fusion control unit supplying the control current to the power supply unit.

BRIEF DESCRIPTION OF THE SEVERAL VIEWS OF THE DRAWINGS

This invention may take physical form in certain parts and arrangements of parts, a preferred embodiment and method of which will be described in detail in this specification and illustrated in the accompanying drawings which form a part hereof, and wherein.

DETAILED DESCRIPTION OF THE INVENTION

Preferred Embodiments

The following is a detailed description of a first embodiment to which the present invention is applicable, referencing diagrams.

First Embodiment

Figure 1:
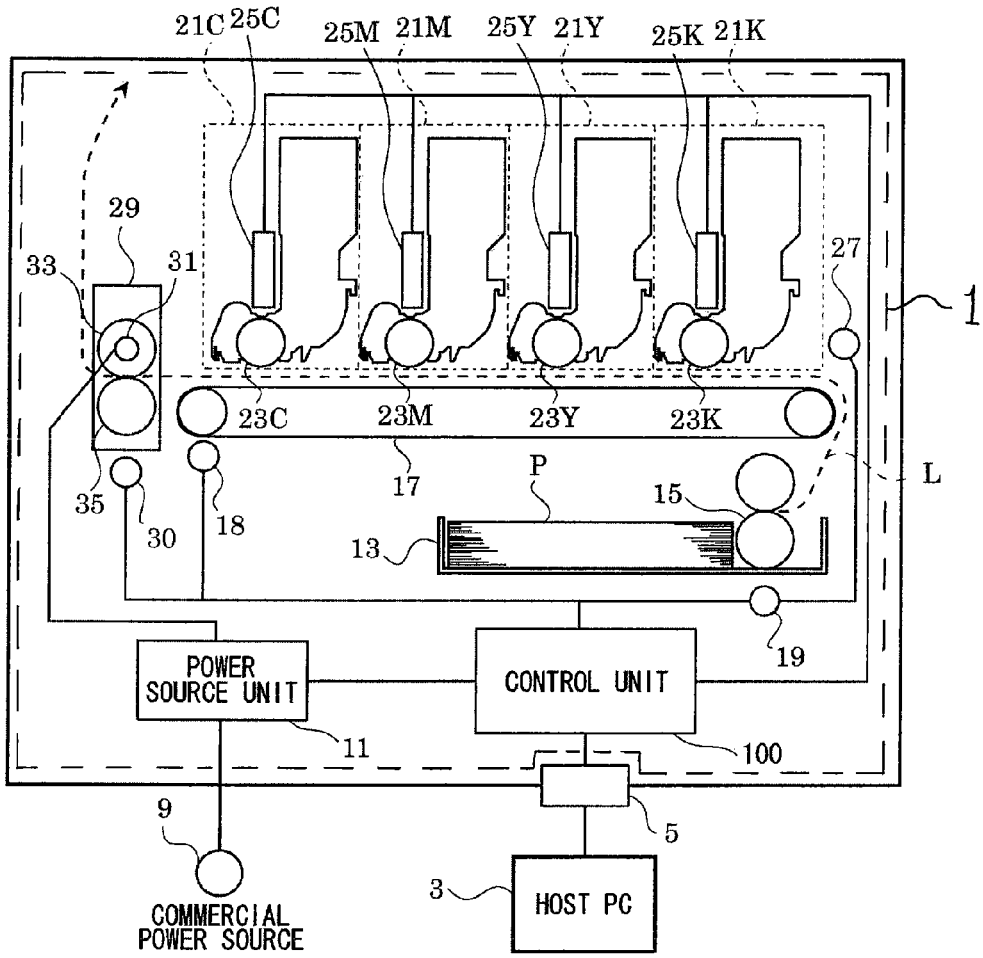
FIG. 1 is a cross-sectional diagram showing essential parts of an image forming apparatus according to a first embodiment of the present invention, and is also a diagram describing the structure of the image forming apparatus.

As shown in FIG. 1, an image forming apparatus 1 is a color printer adopting an electrophotographic process, and is connected to via an interface 5 to a host personal computer 3 (hereinafter referred to as host PC 3) serving as an information processing apparatus for generation of printing information by a user using an application, such as drawing software. When the user sends the printing information to the image forming apparatus 1 using the host PC 3, the image forming apparatus 1 provides the user with a paper P on which a developer image based on the printing information is formed by forming a the developer image on the paper P, which serves as a recording medium, based on the printing information, fusing the developer image formed on the paper P to the paper P, and delivering the paper P onto which the developer image is fused to an external area of the image forming apparatus 1.

The type of image forming apparatus 1 described above contains a control unit 100 for controlling a performance of each unit making up the image forming apparatus 1, and a power source unit 11 for providing power acquired from a commercial power source 9 to each unit, including the control unit 100.

Furthermore, the image forming apparatus 1 contains a paper tray 13 for storing the paper P, which is the printing medium such as recycled paper, glossy paper, or high-quality paper, a hopping roller 15 for sending out the paper P stored in the paper tray 13 in a direction of a prescribed medium feeding path L, and a feeding belt unit 17 for feeding the paper P sent out in a direction of the prescribed medium feeding path L by the hopping roller 15 in a direction further downstream.

Upon sending of the printing information from the host PC, the control unit 100 receives the printing information and initiates a printing performance based on the received printing data. At this time, the control unit 100 rotates the hopping roller 15 by controlling a hopping motor 19 that drives the hopping roller 15, so that the hopping-roller 15 sends out the paper P stored in the paper tray 13 in a downstream direction in the medium feeding path L. The paper P sent out by the hopping roller 15 is fed along the medium feeding path to the feeding belt unit 17.

The feeding belt unit 17 attaches the paper P sent downstream in the medium feeding path L to a belt, and then feeds the paper P to a lower portion of developer units 21C, 21M, 21Y, and 21K. The feeding belt unit 17 is then driven according to a driving force transmitted from a belt motor 18 under the control of the control unit 100. The developer units 21C, 21M, 21Y, 21K develop a developer image based on the printing information input from the host PC 3. The developer units 21C, 21M, 21Y, 21K contain image carriers 23C, 23M, 23Y, 23K, respectively, for carrying the developer image of each color. The image forming apparatus 1 contains LED heads 25C, 25M, 25Y, 25K, corresponding to the image carriers 23C, 23M, 23Y, 23K, for executing exposure based on the printing information. The LED heads 25C, 25M, 25Y, 25K form a latent image, which is based on the printing information, on the image carriers 23C, 23M, 23Y, 23K that are rotated according to the driving force supplied from a drive ID motor 27 under the control of the control unit 100. Each developer unit 21C, 21M, 21Y, and 21K contains a developing unit, not shown, for developing using developer the latent image carried by the image carriers 23C, 23M, 23Y, 23K. The developer image developed using the developer on the image carriers 23C, 23M, 23Y, 23K is then transferred onto the paper P at a time when the paper P passes below the image carriers 23C, 23M, 23Y, 23K.

A fusing device 29 is disposed downstream from the transfer belt unit 17 in the medium feeding path L. The fusing device 29 contains a fusion roller 33, which is driven to rotate by a fusion motor 30, and a pressure roller 35 disposed in a location to face the fusion roller 33. Furthermore, a heating body 31 is disposed inside the fusion roller 33 to heat the fusion roller 33 according to power provided by the power source unit 11.

Upon feeding of the paper P to the fusing device 29 by the transfer belt unit 17, the fusing device 29 sandwiches and feeds the paper P in a direction downstream in the medium feeding path L using the fusion roller 33 heated by the heating body 31 and the pressure roller 35 disposed to face the fusion roller 33. At this time, a surface of the fusion roller 33 is heated by the heat of the heating body 31 according to the power supplied by the power source unit 11. Upon sandwiching and feeding of the paper P by the pressure roller 35 and the fusion roller 33 heated by the heating body 31, the developer affixed to the paper P is melted and fused to the paper P. The paper P onto which the developer image is fused by the fusing device 29 is then fed further downstream in the medium feeding path by a feeding roller or the like, not shown, and delivered to a stacker, not shown, formed externally on the image forming apparatus 1.

The following is a detailed explanation of each unit making up the image forming apparatus 1.

The control unit 100, which operates through the power acquired from the commercial power source 9 by the power source unit 11, controls each unit at a time when the image forming apparatus executes a series of printing processes described above. Specifically, the control unit 100 drives the hopping roller 15 by controlling the drive of the hopping motor 19, thereby sending out the paper P stored in the paper tray 13 in a direction of the medium feeding path L. Furthermore, the control unit 100 supplies a signal based on the printing information to the LED heads 25C, 25M, 25Y, 25K with a prescribed timing and also drives the belt motor 18 and the ID motor 27 to form on the paper P the developer image based on the printing data. In addition, upon initiation of the series of printing processes by the image forming apparatus 1, the control unit 100 heats the heating body 31 to heat the fusion roller 33 through a method described hereinafter.

Figure 2:
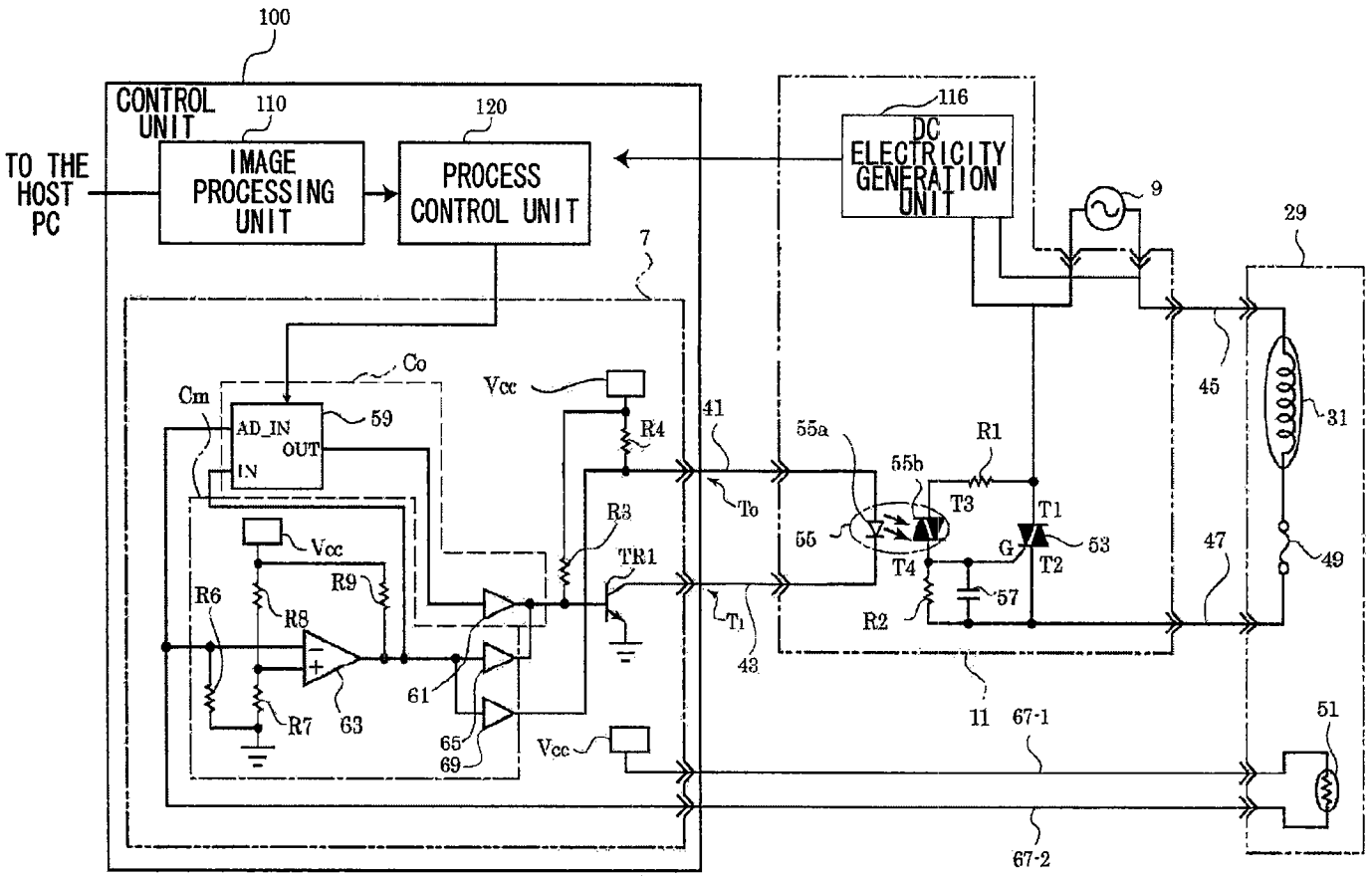
FIG. 2 is a circuit diagram showing the necessary parts of the image forming apparatus, and is also a diagram describing the structure of circuits in a control unit, power source unit, and fusing device.

As shown in FIG. 2, the control unit 100 and the power source unit 11 described above are electrically connected by a first cable 41 and a second cable 43. The heating body 31 is electrically connected to the power source unit 11 by a third cable 45 and a fourth cable 47. The following is a detailed description of a circuit structure of the aforementioned first cable 41, power source unit 11, and fusing device 29.

The fusing device 29 contains the heating body 31 heated by the power supplied from the power source unit 11, a thermal fuse 49 for cutting off a power applied to the heating body 31 in a case where the temperature of the fusing device 29 exceeds a prescribed temperature, and a thermistor 51 serving as a temperature detection unit for detecting the surface temperature of the fusion roller 33 heated by the heating body 31.

One end of the heating body 31 is electrically connected to the power source unit 11 via the third cable 45, and the other end of the heating body 31 is electrically connected to an end of the thermal fuse 49. Furthermore, another end of the thermal fuse 49 is electrically connected to the power source unit 11 via the fourth cable 47. When, for example, power is provided to the fusing device 29 from the power source unit 11, the heating body 31 is heated by this power. Upon heating of the heating body 31, the surface of the fusion roller 33 is heated by the heat radiated from the heating body 31. The heating of the fusion roller 33 is then detected by the thermistor 51.

The power source unit 11 contains a triac 53 for controlling the flow of power from the commercial power source 9 to the heating body 31, a phototriac coupler 55 for joining the first cable 41 and the second cable 43 to the power source unit 11, and a DC (direct-current) electricity generation unit 116 for generating DC electricity necessary for the control unit 100 using the power acquired from the commercial power source 9. The power acquired by the power source unit 11 from the commercial power source 9 is supplied to the fusing device 29 via the third cable 45, the thermal fuse 49, the fourth cable 47, and the triac 53. A terminal T1 of the triac 53 is connected to the commercial power source 9 and is also electrically connected to a terminal T3 of the phototriac coupler 55 via a resistor R1. A terminal T2 of the triac 53 is electrically connected to the thermal fuse 49 via the fourth cable 47. In a case where the heating body 31 is heated in the type of circuit described above, the power of the commercial power source 9 is supplied from the commercial power source 9 to the heating body 31 by turning on the triac 53. Furthermore, the terminal T2 of the triac 53 is electrically connected to a terminal T4 of the phototriac coupler 55 via a resistor R2, and is also electrically connected to one end of a capacitor 57. A terminal T4 of the phototriac coupler 55 is electrically connected to another end of the capacitor 57, and is also electrically connected to a gate terminal of the triac 53.

The phototriac coupler 55 is driven by a control current, output by a fusion control unit 7 to be described hereinafter, for controlling the power supplied to the fusing device 29 from the power source unit 11. The gate terminal of the triac 53 is then driven by the phototriac coupler 55, resulting in conduction between the terminals T1, T2 of the triac 53. Specifically, an anode terminal, serving as an input unit of a LED element 55*a* of the phototriac coupler 55, is electrically connected via the first cable 41 to a control current output terminal $T_O$ for outputting the control current generated by the fusion control unit 7. A cathode terminal serving as an output unit is electrically connected via the second cable 43 to a control current input terminal $T_I$ for inputting to the fusion control unit 7 the control current output from the cathode terminal.

When the control current is sent through the first cable 41 from the fusion control unit 7, the LED element 55*a* outputs the control current through the second cable 43 to generate light. The light generated by the LED element 55*a* reaches a gate unit of a phototriac 55*b*, resulting in conduction between terminals T3, T4 of the phototriac 55*b* to supply a driving current to the gate terminal of the triac 53.

The control unit 100 contains the fusion control unit 7 serving as a fusion control unit for controlling the power supplied to the fusing device 29 from the power source unit 11 based on a detection result of the thermistor 51, an image processing unit 110 for executing each image forming process and for generating image data necessary for printing based on the printing information received from the host PC 3, and a process control unit 120 for controlling each mechanical part and the processes of transferring, developing, exposing, and charging to form the image according to the electrophotographic process based on the image data generated by the image processing unit 110.

The fusion control unit 7 turns the phototriac coupler 55 on or off by supplying the control current to the phototriac coupler 55 based on the detection result of the thermistor, thereby controlling the temperature of the fusing device 29. The fusion control unit 7 described above contains a fusion temperature control circuit $C_O$ for controlling the control current received by the control current input terminal $T_I$ and the control current output from the control current output terminal $T_O$ to keep the temperature of the fusing device 29 within the prescribed range. The fusion control unit 7 also contains a fusing device protection circuit Cm, serving as a fusing device protection unit for shutting off both the control current input terminal $T_I$ and the control current output terminal $T_O$ at a time when the temperature of the fusing device 29 detected by the thermistor 51 is outside the prescribed temperature range.

The fusion temperature control circuit $C_O$ contains a fusion temperature control unit 59 for controlling the control current, and an open collector gate 61 for changing an impedance condition of an output terminal according to the output of the fusion temperature control unit 59.

Figure 3:
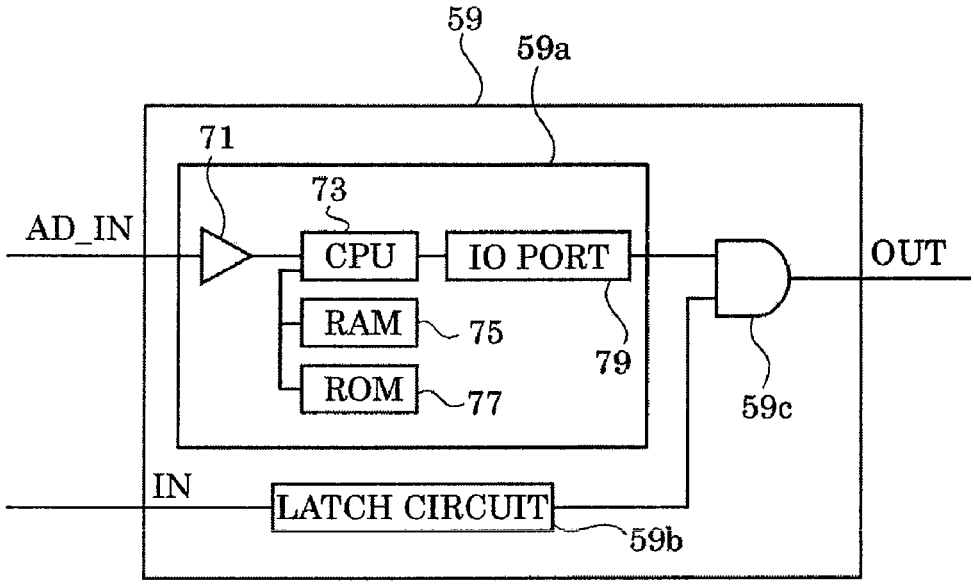
FIG. 3 is a circuit diagram showing control circuits of the control unit, and is also a diagram describing the structure of the control circuits.
Figure 4:
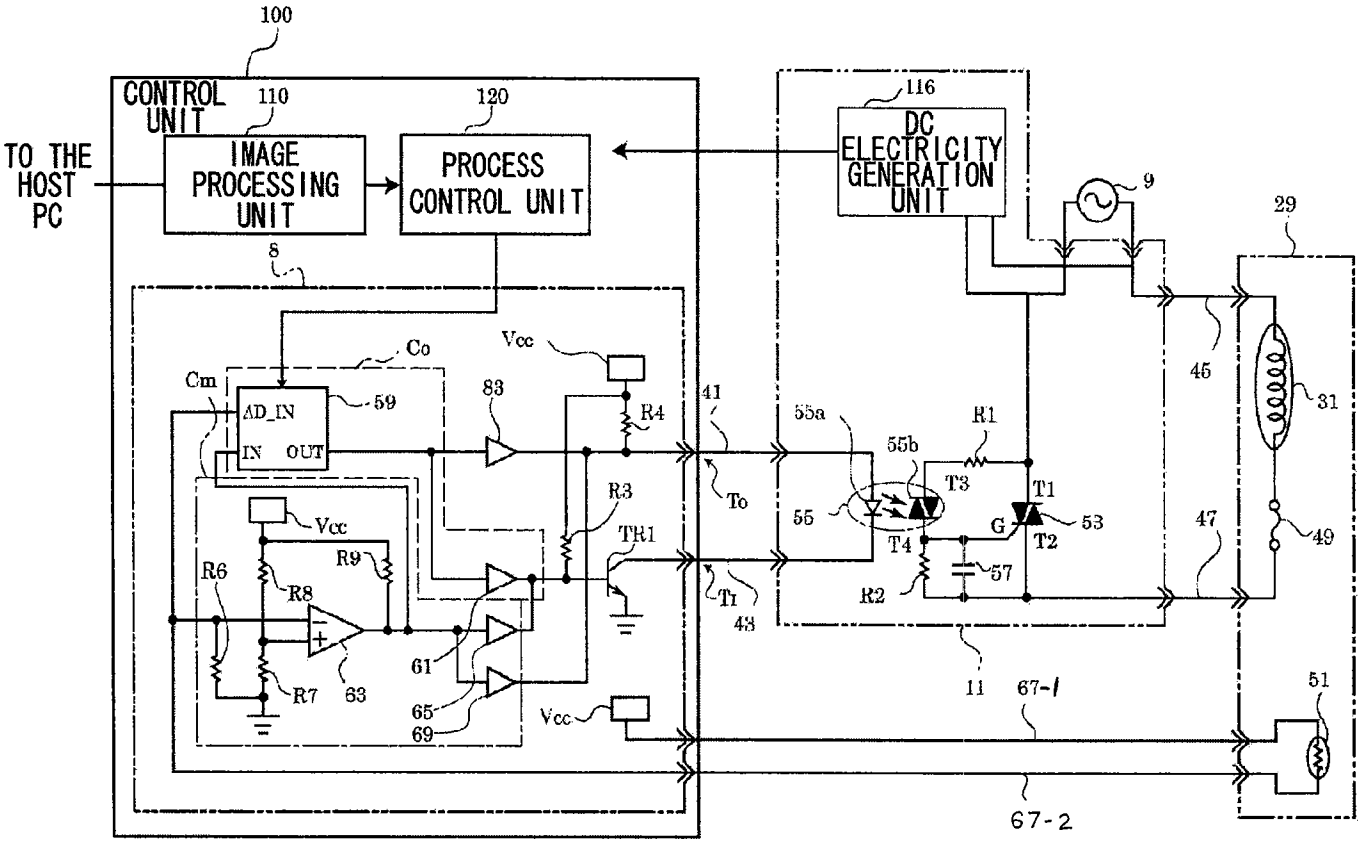
FIG. 4 is a circuit diagram showing the essential parts of the image forming apparatus according to a second embodiment of the present invention, and is also a diagram describing the structure of circuits in the control unit, power source unit, and fusing device.

As shown in FIG. 3, the fusion temperature control unit 59 contains a fusion temperature main control unit 59*a* for generating a temperature control signal of the fusing device 29 based on the temperature detection signal of the thermistor 51, a latch circuit 59*b* for latching the signal input in the input terminal IN, and an AND circuit 59*c* for outputting logical multiplication of the signal output from the fusion temperature main control unit 59*a* and the signal output from the latch circuit 59*b*.

The fusion temperature main control unit 59*a* contains an AD conversion device 71 for converting an analogue signal input from an input terminal AD_IN into a digital signal, a CPU 73, a RAM (Random Access Memory) 75, a ROM (Read Only Memory) 77, and an IO port 79 for outputting the signal generated by the CPU 73.

A program for controlling the heating of the heating body 31 by generating a signal output from an output terminal OUT based on a digital signal showing the temperature of the thermistor 51 read by the CPU 73 from the AD conversion device 71, and a program for notifying a user that the fusion roller 33 is abnormally heated based on the digital signal read by the CPU 73 from the AD conversion device 71 are both stored in the ROM 77.

Furthermore, the image forming apparatus 1 contains an LCD (Liquid Crystal Display) display unit, not shown. The image forming apparatus 1 notifies the user about various types of information using the LCD display unit.

The fusion temperature control unit 59 reads the temperature detection signal of the thermistor 51 input in the input terminal AD_IN, and controls the signal output from the output terminal OUT to keep the temperature of the fusing device 29 within the prescribed range of temperature in which fusion is possible based on read temperature detection signal. The temperature of the fusing device 29 at which fusion is possible is determined based on information relating to various mediums included in the printing information received from the image processing unit 110.

The output terminal OUT of the fusion temperature control unit 59 is connected to an input terminal of the open collector gate 61. Furthermore, an output terminal of the open collector gate 61 is connected to a base terminal of a transistor TR1. The current output from a DC power source Vcc at a time when the open collector gate 61 is off is input to the base terminal of the transistor TR1 via a resistor R3, thereby turning on the transistor TR1. When the transistor TR1 is turned on, the control current flows from the DC power source Vcc to the anode terminal of the LED element 55*a* through the first cable 41, thereby turning on the LED element 55*a*. On the other hand, at a time when the open collector gate 61 is off, the current from the DC power source Vcc cannot be supplied to the base terminal of the transistor TR1, so that the transistor TR1 is turned off. When the transistor TR1 is turned off, the LED element 55*a* is also turned off because the control signal cannot flow to the ground from the LED element 55*a* cathode terminal through the second cable 43. An emitter terminal of the transistor TR1 is grounded, and a collector terminal is electrically connected to the cathode terminal of the LED element 55*a* via the second cable 43. Furthermore, one end of the resistor R3 is electrically connected to the DC power source Vcc, the other end of the resistor R3 is electrically connected to the base terminal of the transistor TR1. The anode terminal of the LED element 55*a* is electrically connected to one end of the resistor R4 via the first cable 41. The other end of the resistor R4 is electrically connected to the DC power source Vcc.

The fusing device protection circuit Cm compares the temperature detection signal of the thermistor 51 to a predetermined threshold value and controls the flow of the control current supplied from the DC power source Vcc to the LED element 55 based on the result of the comparison. The fusing device protection circuit Cm contains a DC power source Vcc, a comparator 63, an open collector gate 65, and an open collector gate 69. A negative terminal of the comparator 63 is electrically connected to one end of the thermistor 51 via a fifth cable 67-2. The other end of the thermistor 51 is electrically connected to the DC power source Vcc via a cable 67-1.

The thermistor 51 is disposed around an upper portion of the fusion roller 33, and a resistance value of the thermistor 51 is changed in association with changing of the surface temperature of the fusion roller 33. A voltage corresponding to the change in the resistance value of the thermistor 51 is supplied to the negative terminal of the comparator 63. Furthermore, one end of the thermistor 51 is electrically connected to the input terminal AD_IN of the fusion temperature control unit 59 via the cable 67-2. In the same manner as described above, a voltage corresponding to the change in the resistance value of the thermistor 51 is supplied from the thermistor 51 to the fusion temperature control unit 59. In addition, one end of the thermistor 51 is electrically connected to a resistor R6, and the other end of the resistor R6 is connected to a ground. One end of a resistor R7 is also connected to a ground, and the other end of the resistor R7 is electrically connected to a positive terminal of the comparator 63. The positive terminal of the comparator 63 is also connected to the DC power source Vcc via a resistor R8. The DC power source Vcc is electrically connected to the input terminal of the open collector gate 69, the open collector gate 65, the input terminal IN of the fusion temperature control unit 59, and the output terminal of the comparator 63 via a resistor R9.

The comparator 63 compares the voltage of the negative terminal to a standard voltage generated by the resistor R8, the resistor R7, and the DC power source Vcc. The standard voltage is determined by considering a normal temperature range shown by the fusion roller 33 at a time of printing. In a case where the result of the comparison by the comparator 63 is that the voltage of the negative terminal is lower than the voltage of the positive terminal, that is, a case where the temperature of the fusion roller 33 detected by the thermistor 51 is within the normal temperature range, the output terminal of the comparator 63 is set to a high impedance. On the other hand, in a case where the voltage of the negative terminal is higher than the voltage of the positive terminal, that is, a case where the temperature of the fusion roller 33 detected by the thermistor 51 is not within the normal temperature range, indicating abnormal heating of the fusion roller 33, the output terminal of the comparator 63 is set to a low impedance.

In the fusion control unit 7, a direction of the flow of the control current flowing from the DC power source Vcc to the LED element 55*a* via the resistor R4 is changed by the impedance condition of the output terminal of the open collector gate 69. Specifically, the direction of the flow of the control current is determined by the impedance condition of the output terminal of the open collector gate 69 to either flow in a direction of the output terminal of the open collector gate 69 or to flow to the anode terminal of the LED element 55*a* through the first cable 41. In the fusion control unit 7, the fusing device protection circuit Cm controls whether to send the control current in the direction of the LED element 55*a* or to draw the control current in the direction of the open collector gate 69 by controlling the impedance condition of the output terminal of the open collector gate 69. At a time when, for example, the impedance condition of the output terminal of the open collector gate 69 is set to a high impedance by the fusing device protection circuit Cm, the control current flows in a direction of the LED element 55*a* via the resistor R4. On the other hand, at a time when the impedance condition of the output terminal of the open collector gate 69 is set to a low impedance by the fusing device protection circuit Cm, the control current is drawn in the direction of the open collector gate 69 via the resistor R4, and therefore the control current is not supplied to the LED element 55*a*. That is, the flow of the control current output from the control current output terminal $T_O$ to the anode terminal of the LED element 55*a* is controlled by the fusing device protection circuit Cm.

Furthermore, to input the control current flowing from the DC power source Vcc to the resistor R4 to the anode terminal of the LED element 55*a* and output the control current from the cathode terminal, it is necessary that an emitter and collector of the transistor TR1 be set in a manner to allow conduction therebetween. It is necessary that current be supplied from the DC power source Vcc to the base terminal of the transistor TR1 via the resistor R3 for conduction in order to allow conduction between the emitter and collector of the transistor TR1. Furthermore, it is necessary that the impedance condition of the output terminals of the open collector gates 61, 65 be set as high impedance for the current to be input into the base terminal of the transistor TR1 via the resistor R3. At a time when, for example, the impedance condition of at least one of either the output terminal of the open collector gate 61 or the output terminal of the open collector gate 65 is set to a low impedance by the fusing device protection circuit Cm or the fusion temperature control unit 59, the current supplied from the DC power source Vcc to the resistor R3 is drawn in a direction of the output terminal of the open collector gate 61 or the output terminal of the open collector gate 65 without flowing to the base terminal of the transistor TR1, so that the LED element 55*a* does not generate light. On the other hand, at a time when the impedance condition of both the output terminal of the open collector gate 61 and the output terminal of the open collector gate 65 is set to a high impedance by the fusing device protection circuit Cm and the fusion temperature control unit 59, the current supplied from the DC power source Vcc to the resistor R3 flows to the base terminal of the transistor TR1. Upon input of the current into the base terminal of the transistor TR1, conduction is made possible between the collector and emitter of the transistor TR1. When conduction is achieved between the collector and emitter of the transistor TR1, the control current can flow from the cathode terminal of the LED element 55*a* to the base terminal of the transistor TR1. That is, the flow of the control current received by the control current input terminal $T_I$ is controlled by the fusion temperature control unit 59, the fusing device protection circuit Cm, the open collector gates 61, 65, and the transistor TR1.

The following is a detailed description of a series of performances of the fusion control unit 7, power source unit 11, and fusing device 29 at a time of heating the fusion roller 33.

Upon sending of the printing information from the host PC 3, the image forming apparatus 1 begins a series of performances to heat the fusion roller 33. First, a detailed description will be given concerning a performance of the image forming apparatus 1 in a case where the series of performances is executed with the surface temperature of the fusion roller 33 within a normal range of temperature at which fusion is possible.

To heat the fusion roller 33, the fusion temperature control unit 59 supplies a high level signal from the output terminal OUT to the input terminal of the open collector gate 61. Upon supplying of the high level signal to the input terminal of the open collector gate 61, the output terminal of the open collector gate 61 is set to a high impedance. When the output terminal of the open collector gate 61 is set to a high impedance, the current flows from the DC power source Vcc to the base terminal of the transistor TR1 via the resistor R3. When the current flows from the DC power source Vcc to the base terminal of the transistor TR1, conduction is allowed between the collector terminal and emitter terminal of the transistor TR1, so that the current can be drawn in a direction of the emitter terminal of the transistor TR1 from the cathode terminal of the LED element 55*a* via the second cable 43. Therefore, the control current flows from the DC power source Vcc to the LED element 55*a* via the resistor R4 and the first cable 41, so that the LED element 55*a* generates light.

When the LED element 55*a* generates light, the phototriac 55*b* of the phototriac coupler 55 turns on, the triac 53 turns on, and conduction is achieved between the terminals T1, T2. When conduction is achieved between the terminals T1, T2 of the triac 53, the current flowing from the commercial power source 9 to the power source unit 11 is supplied to the heating body 31 through the third cable 45. Because the current supplied to the heating body 31 flows in a direction of the fourth cable 47 and the thermal fuse 49, the heating body 31 is heated, and the heating body 31 then heats the fusion roller 33.

At this time, the surface temperature of the fusion roller 33 is detected by the thermistor 51. For example, when the surface temperature of the fusion roller 33 increases, the resistance value of the thermistor 51 decreases. On the other hand, when the surface temperature of the fusion roller 33 decreases, the resistance value of the thermistor 51 increases. That is, the fusion temperature control unit 59 observes the surface temperature of the fusion roller 33 detected by the thermistor 51 through the voltage determined by the thermistor 51, the resistor R6, and the DC power source Vcc.

As a specific method of observation, the fusion temperature control unit 59 converts the voltage determined from the resistance value of the thermistor 51 into a digital signal using the AD conversion device 71. The digital signal converted by the AD conversion device 71 is then read by the CPU 73. The CPU 73 then detects a change in the surface temperature of the fusion roller 33 based on the digital signal and controls the surface temperature of the fusion roller 33 according to a program previously stored in the ROM 77.

The temperature detection signal of the thermistor 51 is also supplied to the negative terminal of the comparator 63. At a time when the surface temperature of the fusion roller 33 is normal, because the voltage of the negative terminal is lower than the voltage of the positive terminal, the output terminal of the comparator 63 is set to a high impedance, and therefore the signal input from the comparator 63 to the input terminal IN of the fusion temperature control unit 59 and the signal supplied to the open collector gates 65, 69 are made into high level signals by the resistor R9. When the high level signal is supplied to the open collector gates 65, 69, the output terminals of the open collector gates 65, 69 are set to a high impedance. In such a condition, the current flowing from the DC power source Vcc to the resistor R4 flows in the direction of the anode terminal of the LED element 55*a*, and the current from the DC power source Vcc to the resistor R3 flows in the direction of the base terminal of the transistor TR1. That is, at a time when the surface temperature of the fusion roller 33 is normal, because the fusing device protection circuit Cm continues to maintain the normal condition, the heating of the heating body 31 and the surface temperature of the fusion roller 33 can be controlled by only the fusion temperature control circuit $C_O$.

In a case where, for example, a series of printing operations is completed and the heating body 31 is turned off by the fusion temperature control unit 59, the fusion temperature control unit 59 supplies a low level signal from the output terminal OUT to the open collector gate 61 via the IO port 79. When the low level signal is supplied to the open collector gate 61, the output terminal of the open collector gate 61 is set to a low impedance. When the output terminal of the open collector gate 61 is set to a low impedance, the current supplied from the DC power source Vcc to the base terminal of the transistor TR1 flows in the direction of the output terminal of the open collector gate 61, so that the transistor TR1 is turned off. When the transistor TR1 is turned off, the control current is not supplied to the LED element 55*a*, so that the LED element 55*a* is turned off. When the LED element 55*a* is turned off, the phototriac 55*b* is also turned off and current is not supplied to the gate terminal of the triac 53, so that the triac 53 is also turned off. When the triac 53 is turned off, conduction is no longer possible between the terminals T1, T2 of the triac 53 and the power acquired from the commercial power source 9 is not supplied to the heating body 31, so that heating of the heating body 31 is stopped. When heating of the heating body 31 is stopped, heating of the fusion roller 33 is also stopped.

As described above, in a case where there is no abnormality in the first cable 41 and the second cable 42, the image forming apparatus 1 controls the temperature of the heating body 31 using the fusion temperature control circuit $C_O$ in the manner described above.

Next, a detailed description is given concerning a performance of the image forming apparatus 1 in a case of a heating abnormality in the surface temperature of the fusion roller 33 for some reason, that is, a case where the surface temperature of the fusion roller 33 is beyond the range of temperature at which fusion is possible.

When the thermistor 51 detects an increase in the surface temperature of the fusion roller 33, the temperature detection signal is input into the AD_IN terminal of the fusion temperature control unit 59 and the negative terminal of the comparator 63. When the voltage of the negative terminal of the comparator 31 then increases and becomes greater than the voltage of the positive terminal, the output terminal of the comparator 63 is set to a low impedance. When the output terminal of the comparator 63 is set to a low impedance, the low level signal is supplied to the open collector gates 65, 69, so that the output terminals of the collector gates 65, 69 are set as a low impedance.

When the output terminal of the open collector gate 65 is set to a low impedance, the current flowing from the DC power source Vcc to the resistor R3 flows in the direction of the output terminal of the open collector gate 65 and the current cannot flow to the base terminal of the transistor TR1, so that the transistor TR1 is turned off.

Furthermore, when the output terminal of the open collector gate 69 is set to a low impedance, the current flowing from the DC power source Vcc to the resistor R4 does not flow in the direction of the anode terminal of the LED element 55*a*, and therefore flows in to the output terminal of the open collector gate 65, so that the LED element 55*a* is turned off. When the LED element 55*a* is turned off, the phototriac 55*b* and the triac 53 are also turned off so that heating of the heating body 31 is stopped, thereby also stopping the heating of the fusion roller 33. As described above, when the temperature detection signal of the thermistor 51 input into the negative terminal of the comparator 63 becomes greater than the positive terminal of the comparator 63, the heating of the fusion roller 33 becomes controlled by the fusing device protection circuit Cm independently from the control of the fusion temperature control unit 59.

Furthermore, when the output terminal of the comparator 63 is set to a low impedance, the signal supplied to the input terminal IN of the fusion temperature control unit 59 becomes a low level signal, and the low level signal is latched by the latch circuit 59*b*.

At a time when the fusion roller 33 is abnormally heated in a case where, for example, the latch circuit 59*b* is not equipped, the flow of the control current is controlled by a performance of the fusing device protection circuit Cm, so that the surface temperature of the fusion roller 33 can be restricted within a certain temperature range. In such a situation, however, when the abnormal heating of the fusion roller 33 continues, there is a concern that the operating life of the fusion roller 33 is shortened. Furthermore, when the abnormal heating of the fusion roller 33 continues, there is a concern that the thermal fuse 49 is activated, thereby burning out.

Through the structure such as that of the image forming apparatus 1 having the latch circuit 59*b*, however, in a case where the abnormal heating condition arises, the latch circuit 59*b* can store the relevant information. Because the latch circuit 59*b* stores the relevant information, even in a case where the image forming apparatus 1 issues a command from the temperature control circuit $C_O$ to heat the fusion roller 33 after the abnormal heating condition arises, the temperature control circuit $C_O$ cannot issue the heating order because of the information stored by the latch circuit 59*b*. By stopping the command for heating the fusion roller 33 issued by the temperature control circuit $C_O$, the heating of the fusion roller 33 in a condition where there is an abnormality in another circuit system is prevented and phenomena such as the shortening of the operating life of the fusion roller 33 or the burning of the thermal fuse 49 can also be prevented.

Next, in a case where the first cable 41 short circuits to the frame ground for some reason, the current flowing from the DC power source Vcc to the resistor R4 flows from the first cable 41 to the ground, thereby stopping the supply of current to the LED element 55*a* and also stopping the supply of power for driving the heating body 31.

In a case where, for example, the first cable 41 is disconnected, a leakage current of the image forming apparatus 1 flows to the anode terminal of the LED element 55*a*, and a defect arises in the fusion temperature control unit, so that the output terminal of the open collector gate 61 is not set to a low impedance. In this case, the LED element 55*a* is not turned off, and therefore the heating body 31 continues to heat the fusion roller 33. In a case where the surface temperature of the fusion roller 33 becomes greater than the prescribed temperature, the output terminal of the comparator 63 is set to a low impedance based on the detection result of the thermistor 51, as described above. Because the output terminal of the open collector gate 65 is also set to a low impedance when the output terminal of the comparator 63 is set to a low impedance, the current flowing from the DC power source Vcc in the direction of the resistor R3 flows in the direction of the output terminal of the open collector gate 65, so that the current is not supplied to the base terminal of the transistor TR1, and therefore the transistor TR1 is turned off. Because the current cannot flow from the anode terminal of the LED element 55*a* to the cathode terminal when the transistor TR1 is turned off, the LED element 55*a* is turned off, so that the supply of power to the heating body 31 is stopped, thereby stopping the heating of the fusion roller 33.

In the manner described above, even in a case where the first cable 41 is damaged for some reason, the flow of the control current can be controlled by the fusing device protection circuit Cm in priority to the fusion temperature control circuit $C_O$, so that the fusion roller 33 can be protected.

Next is a detailed description of a performance of the image forming apparatus 1 in a case where the second cable 43 is damaged for some reason in a condition where power is provided to drive the heating body 31. The image forming apparatus 1 executes the following performance.

First, in a case where the second cable 43 short circuits to the ground for some reason, because the current flowing from the DC power source Vcc in a direction of the resistor R4 flows to a ground formed in the second cable 43, the control current continues to be supplied to the LED element 55*a*, so that the heating body 31 continues to heat the fusion roller 33. Then, in a case where the surface temperature of the fusion roller 33 becomes greater than the prescribed temperature, the output terminal of the comparator 63 is set to a low impedance based on the temperature detection signal of the thermistor 51, as described above. When the output terminal of the comparator 63 is set to a low impedance, the output terminals of the open collector gates 65, 69 are also set to a low impedance, so that the current flowing from the DC power source Vcc via the resistor R4 flows in a direction of the output terminal of the open collector gate 69, thereby stopping the supply of power to the LED element 55*a*. When the control current is not supplied to the anode terminal of the LED element 55*a*, the LED element 55*a* is turned off, so that the supply of power to the heating body 31 is stopped, thereby stopping the heating of the fusion roller 33.

In the present invention, because the generation of light by the LED element 55*a* making up the phototriac coupler 55 can be controlled from both the direction of the cathode terminal and the direction of the anode terminal of the LED element 55*a* using the fusing device protection circuit Cm, the fusion roller 33 is protected even in a case where the second cable 43 short circuits to the ground.

In a case where the first cable 41 or the second cable 43 is disconnected for some reason, because the current flowing from the DC power source Vcc in the direction of the resistor R4 cannot flow to the LED element 55*a* due to the disconnection of the first cable 41 or the second cable 43, the supply of current to the LED element 55*a* is stopped, thereby stopping the supply of power for driving the heating body 31.

In the image forming apparatus 1 according to the first embodiment, by controlling generation of the light by the LED element 55*a* from both sides of the cathode terminal and the anode terminal of the LED element 55*a* making up the phototriac coupler 55 based on the detection result of the thermistor 51 as described above, the surface temperature of the fusion roller 33 can be controlled to protect the fusing device 29 even in a case where the first cable 41 or the second cable 43 connecting the fusion control unit 7 to the power source unit 11 is damaged.

In a case where, for example, in addition to disconnection of the first cable 41 for some reason, voltage is applied to the anode terminal of the LED element 55*a* by the leakage current, while the fusion temperature main control unit 59*a* breaks down and thus the high level signal is continually output from the output terminal OUT, the image forming apparatus can set the output terminal of the open collector gate 65 to a low impedance based on the signal output from the comparator 63, so that the surface temperature of the fusion roller 33 can be controlled to protect the fusing device 29.

In the image forming apparatus 1, because the protection of the fusion roller 33 can be maintained using the latch circuit 59*b*, the shortening of the operating life of the fusing device 29 and the burning of the thermal fuse 49 can be prevented.

Second Embodiment

Next, a detailed description is given concerning an image forming apparatus according to a second embodiment of the present invention. In addition, because certain parts of the image forming apparatus according to the second embodiment are the same as those of the image forming apparatus 1, these parts have the same number and the detailed description is omitted.

A fusion control unit 8 of the image forming apparatus according to the second embodiment includes in the structure of the fusion control unit 7 an open collector gate 83 between an output terminal OUT of the fusion temperature control unit 59 and one end of the resistor R4. Specifically, an output terminal of the open collector gate 83 is electrically connected to the anode terminal of the LED element 55*a* via the first cable 41, and an input terminal of the open collector gate 83 is electrically connected to the output terminal OUT of the fusion temperature control device 59.

When the surface temperature of the fusion roller 33 increases for some reason, the voltage of the AD_IN terminal of the fusion temperature control unit 59 and the negative terminal of the comparator 63 is increased by the change in the resistance value of the thermistor 51, and when the voltage of the negative terminal of the comparator 63 becomes greater than the voltage of the positive terminal, the output terminal of the comparator 63 is set to a low impedance. When the output terminal of the comparator 63 is set to a low impedance, the low level signal is supplied to the open collector gates 65, 69 to set the output terminals of the open collector gates 65, 69 to a low impedance.

When the output terminal of the open collector gate 65 is set to a low impedance, the current flowing from the DC power source Vcc to the resistor R3 flows in the direction of the output terminal of the open collector gate 65, and therefore the current cannot flow to the base terminal of the transistor TR1, so that the transistor TR1 is turned off.

When the temperature detection signal output from the thermistor 51 at this time is input into the input terminal AD_IN of the fusion temperature control unit 59, the low level signal is output from the output terminal OUT of the fusion temperature control unit 59. When the low level signal is output from the output terminal OUT of the fusion temperature control unit 59, this signal is input into the input terminals of the open collector gates 61, 83. When the low level signal is input into the input terminals of the open collector gates 61, 83, the output terminals of the open collector gates 61, 83 are set to a low impedance. When the output terminals of the open collector gate 83 is set to a low impedance, the current flowing from the DC power source Vcc to the resistor R4 flows in the direction of the output terminal of the open collector gate 83 without flowing in the direction of the LED element 55*a*, so that the LED element 55*a* is turned off. When the LED element 55*a* is turned off, the phototriac 55*b* and the triac 53 are also turned off, so that heating of the heating body 31 is stopped, thereby also stopping the heating of the fusion roller 33.

In a case where the second cable 43 short circuits to the frame ground for some reason while the fusion roller 33 is being heated, the thermistor changes the resistance value according to the increase in the surface temperature of the fusion roller 33, so that the voltage of the input terminal AD_IN of the fusion temperature control unit 59 increases. The fusion temperature control unit 59 detects the increase in the surface temperature of the fusion roller 33 based on the voltage increase of the input terminal AD_IN and outputs the low level signal from the output terminal OUT. When the low level signal is supplied from the output terminal OUT, the output terminal of the open collector gate 83 is set to a low impedance, and therefore the current flowing from the DC power source Vcc via the resistor R4 flows in the direction of the output terminal of the open collector gate 83. Furthermore, when the low level signal is supplied from the output terminal OUT, the current flowing to the base terminal of the transistor TR1 flows in the direction of the output terminal of the open collector gate 61, and therefore the current is not drawn from the cathode terminal of the LED element 55*a*. In the manner described above, because the current is neither output from nor input into the LED element 55*a*, the LED element 55*a* does not generate light and the supply of power for driving the heating body 31 is stopped.

In the manner described above, in a case where the second cable 43 short circuits to the ground for some reason, the fusion temperature control unit 59 can control the LED element 55*a* by turning on the open collector gate 83. By controlling the generation of light by the LED element 55*a* using the fusion temperature control unit 59 as described above, the surface temperature of the fusion roller 33 can be controlled and the fusing device 29 can be protected. Furthermore, even in a case where the second cable 43 short circuits to the ground for some reason and a defect arises in the fusion temperature main control unit 59*a*, when the abnormal temperature is detected by the fusing device protection circuit Cm, the result is input into the fusion temperature control circuit $C_O$ and latched by the latch circuit 59*b*. Therefore, the output from the fusion temperature control circuit $C_O$ to the open collector gate 83 is usually turned off to maintain the output terminal of the open collector 83 at a low impedance, so that the control current is not input into the anode terminal of the LED element 55*a*. In the manner described above, according to the second embodiment, even in a case where the second cable 43 short circuits to the ground for some reason, heating of the fusion roller 33 can be stopped independently from the protection of the fusion roller 33 by the fusing device protection circuit Cm.

In the aforementioned embodiments, the detailed description of the present invention was given as applied to a color printer, but the present invention is not limited to the aforementioned embodiments and can also be applied to any type of arbitrary image forming apparatus equipped with a fusing device.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image forming apparatus, comprising:

a fusing device for heating a heating body with supplied power to fuse developer onto a printing medium;

a power supply unit for supplying the power to said fusing device;

a temperature detection unit for detecting a temperature of said fusing device;

a fusion control unit for controlling the power supplied to said fusing device from said power supply unit based on a detection result of said temperature detection unit;

an input unit, electrically isolated from said power supply unit, for receiving a control current for controlling the power supplied to said heating body from said power supply unit; and an output unit, electrically isolated from said power supply unit, for outputting the control current received by said input unit, wherein said fusion control unit comprises:

a control current output unit for outputting the control current to said input unit;

a control current input unit for receiving the control current output from said control current output unit;

a control current output control unit for controlling the control current output by said control current output unit based on the detection result of said temperature detection unit; and a control current input control unit for controlling the control current received by said control current input unit based on the detection result of said temperature detection unit.

2. The image forming apparatus according to claim 1, wherein said fusion control unit comprises:

a fusion temperature control unit for controlling either one or both of the control current received by said control current input unit and the control current output from said control current output unit to set the temperature of said fusing device to a temperature at which fusion is possible; and a fusing device protection control unit for cutting off both the control of the control current by said control current input control unit and the control of the control current by said control current output control unit at a time when the temperature of said fusing device detected by said temperature detection unit is outside of a prescribed temperature range.

3. The image forming apparatus according to claim 2, wherein:

said fusing device protection control unit comprises a comparison unit for comparing a range of values representing the prescribed temperature of said fusing device and the detection result of said temperature detection unit; and said fusing device protection control unit gives priority to control by said fusion temperature control unit, based on a comparison result of said comparison unit, and cuts off both the control of the control current by said control current input control unit and the control of the control current by said control current output unit.

4. The image forming apparatus according to claim 3, wherein:

said fusion temperature control unit comprises a storage unit for storing the comparison result of the comparison unit; and said fusion temperature control unit controls either one or both of said control current output control unit and said control current input control unit based on the comparison result stored in said storage unit.

5. The image forming apparatus according to claim 4, further comprising a first cable connecting the control current output unit of said fusion control unit to said input unit, and a second cable connecting the control current output unit of said fusion control unit to said output unit.

6. The image forming apparatus according to claim 4, comprising a light generating element for generating light based on the control current output from said output unit and the control current received by said input unit, wherein:

said power supply unit comprises a light receiving element for receiving the light generated by said light generating element; and said power supply unit provides the power to said fusing device according to a condition of said light receiving element.

7. The image forming apparatus according to claim 3, further comprising a first cable connecting the control current output unit of said fusion control unit to said input unit, and a second cable connecting the control current output unit of said fusion control unit to said output unit.

8. The image forming apparatus according to claim 3, comprising a light generating element for generating light based on the control current output from said output unit and the control current received by said input unit, wherein:

said power supply unit comprises a light receiving element for receiving the light generated by said light generating element; and said power supply unit provides the power to said fusing device according to a condition of said light receiving element.

9. The image forming apparatus according to claim 2, further comprising a first cable connecting the control current output unit of said fusion control unit to said input unit, and a second cable connecting the control current output unit of said fusion control unit to said output unit.

10. The image forming apparatus according to claim 2, comprising a light generating element for generating light based on the control current output from said output unit and the control current received by said input unit, wherein:

said power supply unit comprises a light receiving element for receiving the light generated by said light generating element; and said power supply unit provides the power to said fusing device according to a condition of said light receiving element.

11. The image forming apparatus according to claim 1, further comprising a first cable connecting the control current output unit of said fusion control unit to said input unit, and a second cable connecting the control current output unit of said fusion control unit to said output unit.

12. The image forming apparatus according to claim 1, comprising a light generating element for generating light based on the control current output from said output unit and the control current received by said input unit, wherein:

said power supply unit comprises a light receiving element for receiving the light generated by said light generating element; and said power supply unit provides the power to said fusing device according to a condition of said light receiving element.

* * * * *